US007421865B2

(12) United States Patent
Lee et al.

(10) Patent No.: US 7,421,865 B2
(45) Date of Patent: Sep. 9, 2008

(54) WASHING MACHINE WITH DRYING FUNCTION AND METHOD OF CONTROLLING THE SAME

(75) Inventors: Tae Hee Lee, Buchun-si (KR); Byung Keol Choi, Inchun-si (KR); Hyun Seok Seo, Inchun-si (KR); Sang Wook Hong, Seoul (KR); Moon Hee Hong, Seoul (KR); Si Moon Jeon, Seoul (KR); Byoung Soo Je, Seoul (KR); Hee Tae Lim, Buchun-si (KR)

(73) Assignee: LG Electronics Inc., Seoul (KR)

( * ) Notice: Subject to any disclaimer, the term of this patent is extended or adjusted under 35 U.S.C. 154(b) by 219 days.

(21) Appl. No.: 11/012,272

(22) Filed: Dec. 16, 2004

(65) Prior Publication Data

US 2005/0132757 A1 Jun. 23, 2005

(30) Foreign Application Priority Data

| | | |
|---|---|---|
| Dec. 18, 2003 | (KR) | 10-2003-0093189 |
| Apr. 9, 2004 | (KR) | 10-2004-0024493 |
| Apr. 9, 2004 | (KR) | 10-2004-0024494 |
| Apr. 23, 2004 | (KR) | 10-2004-0028213 |
| Sep. 3, 2004 | (KR) | 10-2004-0070470 |

(51) Int. Cl.
*D06F 25/00* (2006.01)

(52) U.S. Cl. ..... 68/15; 68/19.1; 68/20

(58) Field of Classification Search ..... 68/15, 68/207, 140
See application file for complete search history.

(56) References Cited

U.S. PATENT DOCUMENTS

| | | | | |
|---|---|---|---|---|
| 1,463,016 | A * | 7/1923 | Humberger | 68/20 |
| 2,193,495 | A * | 3/1940 | Rolkern | 8/159 |
| 2,417,998 | A * | 3/1947 | Wales | 68/12.22 |
| 2,717,456 | A | 9/1955 | Smith | |
| 3,739,145 | A * | 6/1973 | Woehler | 392/441 |
| 4,024,735 | A | 5/1977 | Marchiselli et al. | |
| 4,112,590 | A | 9/1978 | Muller | |
| 6,954,995 | B2 * | 10/2005 | Kitamura et al. | 34/597 |

FOREIGN PATENT DOCUMENTS

| | | |
|---|---|---|
| CN | 527950 | 9/1972 |

(Continued)

OTHER PUBLICATIONS

European Patent Office 0 704 569 Apr. 1996.*

(Continued)

*Primary Examiner*—Frankie L. Stinson
(74) *Attorney, Agent, or Firm*—Birch, Stewart, Kolasch & Birch, LLP

(57) ABSTRACT

Disclosed herein is a washing machine with drying function. A heater is mounted in a tub for heating wash water or air in the tub. A circulating channel is connected to the tub for guiding air heated by the heater to the outside of the tub and then supplying the air into a drum such that the laundry in the drum is dried. Consequently, the structure of the washing machine with drying function is simplified, the manufacturing costs of the washing machine with drying function are reduced, and noise generated from the washing machine with drying function is minimized.

21 Claims, 11 Drawing Sheets

FOREIGN PATENT DOCUMENTS

| | | | | |
|---|---|---|---|---|
| DE | 1 460 875 | | | 4/1969 |
| DE | 1 460 878 | | | 4/1969 |
| DE | 1 585 938 | | | 9/1969 |
| DE | 1610046 | | | 11/1970 |
| DE | 2047856 | | | 3/1972 |
| DE | 2445211 | | | 4/1976 |
| DE | 26 52 688 | | | 6/1977 |
| DE | 30 17 109 | A1 | | 11/1981 |
| EP | 704569 | A | | 4/1996 |
| GB | 1523262 | | | 8/1978 |
| GB | 2230330 | A | | 10/1990 |
| JP | 4-28395 | | * | 1/1992 |
| JP | 5-76683 | | * | 3/1993 |
| JP | 09-173678 | | | 7/1997 |
| KR | 10-2002-0056036 | A | | 7/2002 |

OTHER PUBLICATIONS

WIPO WO 89/02003 Mar. 1989.*

* cited by examiner

WASHING MACHINE WITH DRYING FUNCTION AND METHOD OF CONTROLLING THE SAME

BACKGROUND OF THE INVENTION

1. Field of the Invention

The present invention relates to a washing machine with drying function, and, more particularly, to a washing machine with drying function that is capable of minimizing the flow resistance of air caused by a condensing duct although the washing machine with drying function is manufactured with a simple structure at low costs, whereby the drying performance of the washing machine with drying function is improved.

The present invention also relates to a method of controlling the same.

2. Description of the Related Art

Generally, a washing machine is a machine that removes contaminants from clothes or bedclothes (hereinafter, referred to as "the laundry") with water containing a detergent dissolved therein or clean water (hereinafter, referred to as "wash water"). Recently, the washing machine has been provided with various auxiliary units, such as a drying unit for drying the laundry.

FIG. 1 is a side sectional view, cutaway in part, illustrating the inner structure of a conventional washing machine with drying function.

As shown in FIG. 1, the conventional washing machine with drying function comprises: a cabinet 2; a tub 10 mounted in the cabinet 2 for receiving wash water; a drum 20 rotatably disposed in the tub for receiving the laundry m; a motor 30 for rotating the drum while supporting the drum 20; and a drying unit 40 for drawing air out of the drum 20, condensing and heating the drawn air, and supplying the condensed and heated air into the drum 20 to dry the laundry m.

The cabinet 2 is provided at one side thereof with an inlet/outlet hole 3 for allowing the laundry m to be put into or taken out of the cabinet 2 therethrough. To the cabinet 2 is hingedly attached a door 4 for opening and closing the inlet/outlet hole 3.

The door 4 comprises: a doorframe 4*a* hingedly connected to the cabinet 2; and a door glass 4*b* attached to the doorframe 4*a*. The door glass 4*b* is formed such that the door glass 4*b* is convex toward the rear of the door glass 4*b*.

The tub 10 is connected to a spring 5, which is connected to the top part of the cabinet 2, while the tub 10 is suspended by the spring 5. Also, the tub 10 is laid on a damper mounted to the bottom part of the cabinet 2, while the tub 10 is supported by the damper 6, such that shock applied to the tub 10 is absorbed by the damper 6.

To the tub 10 is connected a water-supply unit 12 for supplying wash water, which is supplied from the outside of the washing machine, into the tub 10. To the tub 10 is also connected a drainage unit 14 for draining wash water in the tub 10 out of the washing machine.

To the inner bottom part of the tub is mounted a washing heater 15 for heating wash water such that the laundry can be boiled by the heated wash water.

To the tub 10 is attached a gasket 16, which is closely coupled to the door 4, when the door 4 is closed, for preventing the laundry m, wash water, and air from flowing out of the space between the door 4 and the tub 10.

At the gasket 16 is formed a tub-shaped drying unit connection member 18, to which the drying unit 40 is connected, while the drying unit connection member 18 is protruded from one side of the gasket 16.

Specifically, the drying unit connection member 18 is formed at the outer circumferential part of the gasket 16 while being protruded in the radial direction of the gasket 16.

The drum 20 is provided with an inlet/outlet hole 21 for allowing the laundry m, wash water, and air to be introduced into and taken out of the drum 20 therethrough, and through-holes 22 for allowing wash water and air to be introduced into and discharged out of the drum 20 therethrough.

The motor 30 is supported by the tub 10 through a bearing disposed between the motor 30 and the tub 10 while a rotary shaft of the motor 30 penetrates the tub 10. The end of the motor is connected to the drum 20.

The drying unit 40 comprises: a condensing duct 42 connected to one side of the tub 10; a cooling water valve 43 for allowing cooling water to flow therethrough or stopping the cooling water from flowing therethrough; a cooling water hose 44 connected to the cooling water valve 43 for injecting cooling water into the condensing duct 42; a drying duct 48 communicating with the condensing duct 42 and having a circulating fan 45 and a drying heater 46 mounted therein for supplying high-temperature and low-humidity air into the drum 20; and a fan motor mounted to the drying duct 48 for rotating the circulating fan 45.

The condensing duct 42 has one end connected to the tub 10 while being perpendicular to the tub 10, and the other end connected to the drying duct 48.

The drying duct 48 has an outlet fixedly connected to the drying unit connection member 18 of the gasket 16 in such a manner that the outlet of the drying duct 48 is inserted in or fitted on the drying unit connection member 18.

The operation of the conventional washing machine with drying function will be described below.

When a user puts the laundry m into the drum 20, closes the door 4, and operates the washing machine, wash water is supplied to the washing machine through the water-supply unit 12.

The supplied wash water is introduced into the tub 10 such that the wash water is filled in the tub 10, and is also introduced into the drum 20 through the inlet/outlet hole 21 or the through-holes 22 of the drum 20 such that the laundry m is wetted by the wash water.

When the motor 30 is driven after the wash water is supplied as described above, the drum 20 is rotated. As a result, the laundry m is shaken in the drum 20 so that stains are removed by the wash water.

If the boiling mode is selected during the washing operation of the washing machine with drying function, the washing heater 15 is turned on to heat the wash water in the tub 10.

When the washing operation of the washing machine is finished as described above, the contaminated wash water in the tub 10 is drained out of the washing machine through the drainage unit 14.

Thereafter, several rinsing operations of the washing machine are carried out for rinsing out bubbles left in the laundry m. The water-supply unit 12 and the motor 30 are controlled to rinse out the bubbles left in the laundry as in the washing operation, and the contaminated water, including the bubbles, is drained out of the washing machine through the drainage unit 14.

After the rinsing operations of the washing machine are carried out several times as described above, the dewatering operation is carried out for centrifugally separating moisture from the laundry m.

As the dewatering operation of the washing machine has been finished as described above, the drying unit 40 is operated to dry the laundry m.

The motor 30 is driven to rotate the drum 20, and the cooling water valve 43, the circulating fan 45, and the drying heater 46 are turned on. In this way, the drying operation of the washing machine is carried out.

As the cooling water valve 43 is opened, the cooling water is injected into the condensing duct 42. As the circulating fan 45 is rotated, low-temperature and high-humidity air in the drum 20 is introduced into the condensing duct 42 through the tub 10. Moisture in the air is condensed by the cooling water while the air passes through the condensing duct 42.

The air having passed through the condensing duct 42 is guided through the drying duct 48. At this time, the air is heated by the drying heater 46, and therefore the air is changed into hot wind. The hot wind passes through the drying unit connection member 18 of the gasket 16, is guided to the inside of the gasket 16, strikes the door glass 4*b* of the door 4, and is then blown toward the drum 20 such that the laundry is dried by the blown hot wind. As a result, the hot wind is changed into low-temperature and high-humidity air.

In the conventional washing machine with drying function as described above, however, noise is increased due to the presence of the circulating fan 45 and the fan motor 49. Also, the manufacturing costs of the washing machine with drying function are increased due to the provision of the drying duct 48, the condensing duct 42, the circulating fan 45, and the fan motor 49. In addition, a circulating channel, which is defined by the condensing duct 42 and the drying duct 48, is complicated with the result that the flow resistance of air is increased. Also, the capacities of the tub 10 and the drum 20 are decreased as much as the space occupied by the condensing duct 42.

Furthermore, the condensing duct 42 is connected to the tub 10 while being perpendicular to the tub 10 in the conventional washing machine with drying function, with the result that the flow resistance of air introduced into the condensing duct 42 from the tub 10 is increased. Consequently, power consumption of the drying heater 46 is considerably increased.

SUMMARY OF THE INVENTION

Therefore, the present invention has been made in view of the above problems, and it is an object of the present invention to provide a washing machine with drying function that is capable of running with reduced noise while capacities of a tub and a drum of the washing machine with drying function are increased although the washing machine with drying function is manufactured with a simple structure at low costs, whereby washing and drying capacities of the washing machine with drying function are increased.

It is another object of the present invention to provide a method of controlling a washing machine with drying function that is capable of preventing a heater of the washing machine with drying function from being overheated and damaged.

In accordance with one aspect of the present invention, the above and other objects can be accomplished by the provision of a washing machine with drying function, comprising: a tub disposed in a cabinet while being supported; a drum rotatably disposed inside the tub for receiving the laundry, the drum being provided with through-holes; a driving unit for rotating the drum; a heater mounted to the tub for heating wash water or air in the tub; and a circulating channel for guiding air heated by the heater to the outside of the tub and then supplying the air into the drum.

Preferably, the circulating channel extends near the heater.

Preferably, the tub is provided with a heater-accommodating groove part for accommodating the heater, and the circulating channel has one end communicating with the heater-accommodating groove part.

Preferably, the washing machine with drying function further comprises: a cooling water supplying means for supplying cooling water to an inner wall of the tub to condense air inside the tub.

Preferably, the cooling water supplying means comprises: a cooling water supplying member formed at the tub for guiding the cooling water to the inner wall of the tub; a cooling water valve connected to an external hose for allowing cooling water supplied from the external hose to flow therethrough or stopping the cooling water from flowing therethrough; and a cooling water supplying hose, having one end communicating with the cooling water valve and the other end communicating with the cooling water supplying member, for guiding cooling water having passed through the cooling water valve to the inner wall of the tub.

Preferably, the tub comprises: a double wall part having a cooling channel defined between an inner wall and an outer wall of the tub, and the washing machine with drying function further comprises: a cooling fluid supplying means for supplying cooling water to the cooling channel.

Preferably, the cooling fluid supplying means comprises: a cooling water supplying member formed at the tub while communicating with the cooling channel of the tub; a cooling water valve connected to an external hose for allowing cooling water supplied from the external hose to flow therethrough or stopping the cooling water from flowing therethrough; and a cooling water supplying hose, having one end communicating with the cooling water valve and the other end communicating with the cooling water supplying member, for guiding cooling water having passed through the cooling water valve to the cooling water supplying member.

Preferably, the washing machine with drying function further comprises: a door for opening and closing a laundry inlet/outlet hole formed at the cabinet; and a gasket attached to the tub for sealing the space between the door and the tub when the door is closed. The circulating channel comprises: a tub-side communicating hole part formed at one side of the tub for allowing air in the tub to flow out of the tub therethrough; a circulating duct having one end connected to the tub-side communicating hole part and the other end extending to the outer circumferential part of the gasket; and a gasket-side communicating hole part formed at the gasket for allowing air guided into the circulating duct to flow to the inside of the gasket therethrough.

In accordance with another aspect of the present invention, there is provided a method of controlling a heater mounted in a tub of a washing machine with drying function for heating wash water or air in the tub and a motor mounted to the tub for rotating a drum, the method comprising the steps of: during a drying operation of the washing machine with drying function, driving the motor at a speed of more than a predetermined level to rotate the drum at high speed such that air inside the drum flows to the heater, passes through a circulating channel, and is then supplied into the drum; and turning the heater on.

Preferably, the method further comprises the step of: during the drying operation of the washing machine with drying function, turning on a cooling water valve to supply cooling water to an inner wall of the tub or a cooling channel defined between an inner wall and an outer wall of the tub.

Preferably, the method further comprises the steps of: turning on the heater when RPM of the motor is more than a predetermined level; and turning off the heater when RPM of the motor is less than the predetermined level.

The washing machine with drying function of the present invention has an effect in that the heater is mounted in the tub for heating wash water or air in the tub, and the circulating channel is connected to the tub for guiding the air, heated by the heater, to the outside of the tub and then supplying the air into the drum such that the laundry in the drum is dried, whereby a drying heater, a circulating fan, and a fan motor are not required, and therefore, the structure of the washing machine with drying function is simplified, the manufacturing costs of the washing machine with drying function are reduced, and noise generated from the washing machine with drying function is minimized.

The washing machine with drying function of the present invention has an effect in that capacities of the tub and the drum are increased as much as the space occupied by the drying heater and the condensing duct, whereby washing and drying capacities of the washing machine with drying function are increased.

The washing machine with drying function of the present invention has an effect in that the washing machine with drying function further comprises the cooling water supplying means for supplying cooling water to the inner wall of the tub such that high-humidity air inside the tub is condensed by the cooling water flowing along the inner wall of the tub, whereby an additional condensing duct is not required, and therefore, the structure of the washing machine with drying function is simplified, and the manufacturing costs of the washing machine with drying function are reduced.

The washing machine with drying function of the present invention has an effect in that the tub comprises the double wall part having the cooling channel defined between the inner wall of the tub and the outer wall of the tub, and the washing machine with drying function further comprises the cooling fluid supplying means for supplying cooling water to the cooling channel such that high-humidity air inside the tub is condensed through heat exchange between the air and the inner wall of the tub, whereby an additional condensing duct is not required, and therefore, the structure of the washing machine with drying function is simplified, the manufacturing costs of the washing machine with drying function are reduced, and condensing efficiency of the washing machine with drying function is improved as the heat exchange area of the high-humidity air is increased.

Also, the method of controlling the washing machine with drying function according to the present invention has an effect in that the heater is turned on when the motor is rotated at a speed of more than a predetermined level, and turned off when the motor is rotated at a speed of less than the predetermined level, whereby the heater is prevented from being overheated and damaged.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
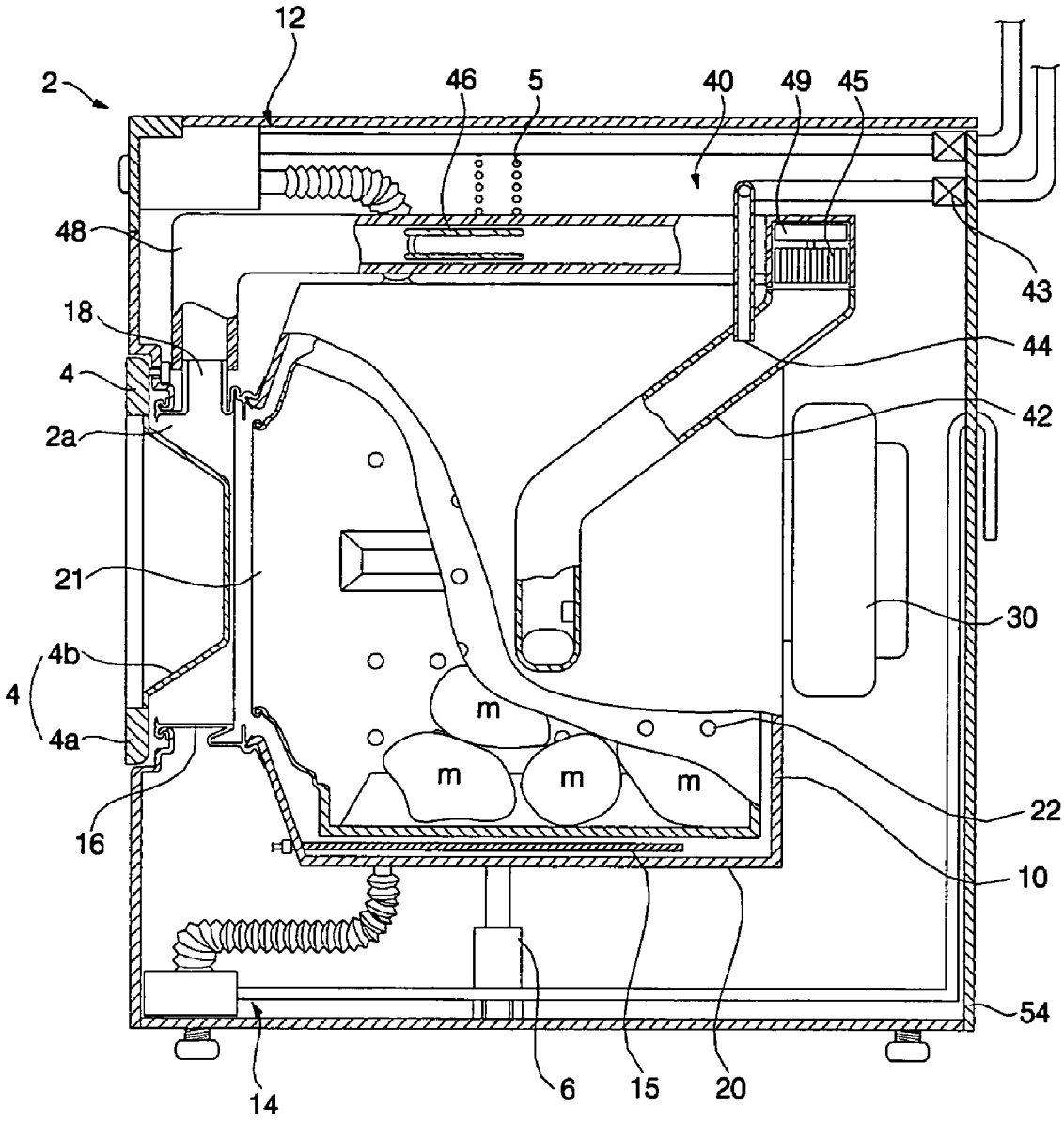
FIG. 1 (Prior Art)
FIG. 1 is a side sectional view illustrating a conventional washing machine with drying function.
Figure 2:
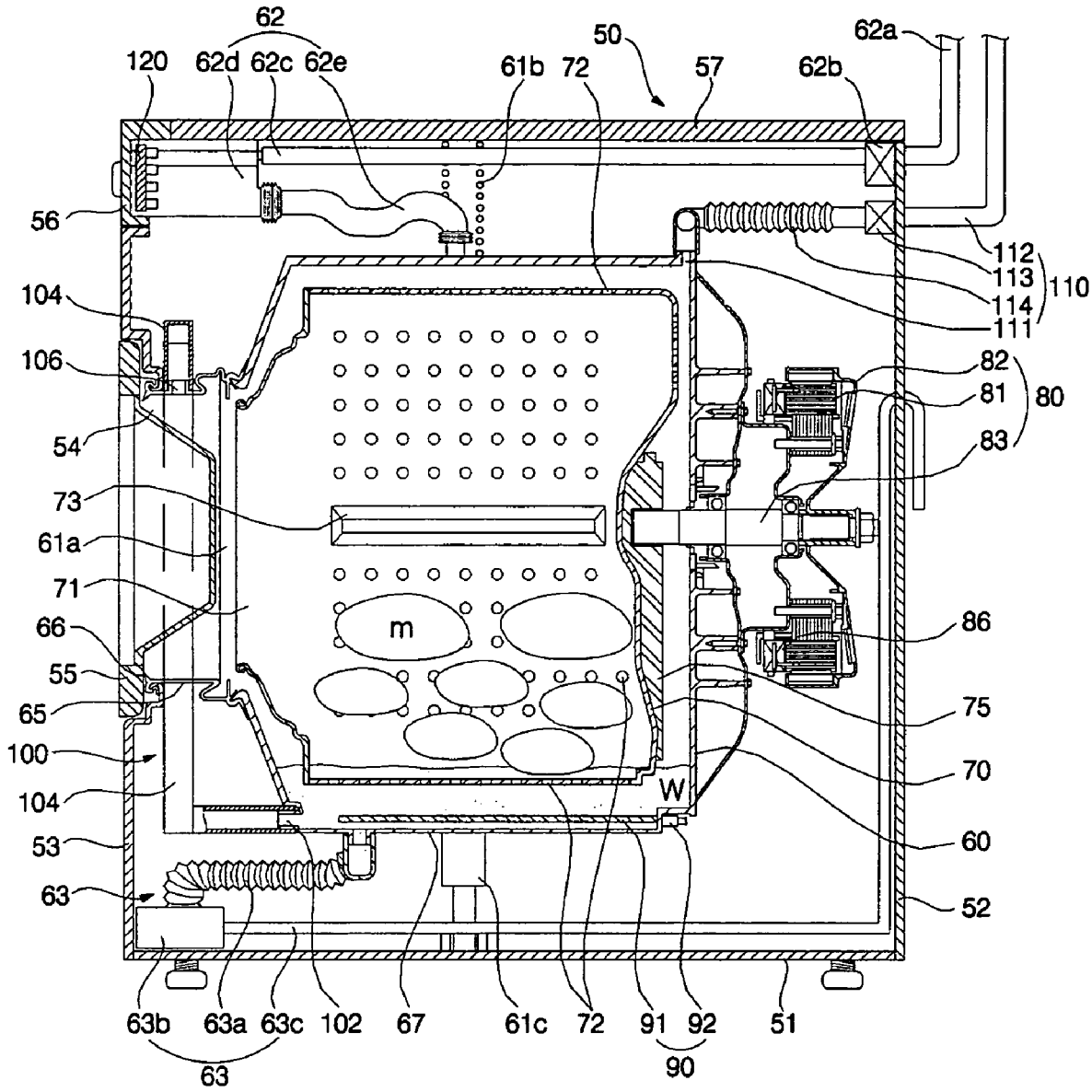
FIG. 2 is a longitudinal sectional view illustrating a washing machine with drying function according to a first preferred embodiment of the present invention during the washing operation of the washing machine with drying function.
Figure 3:
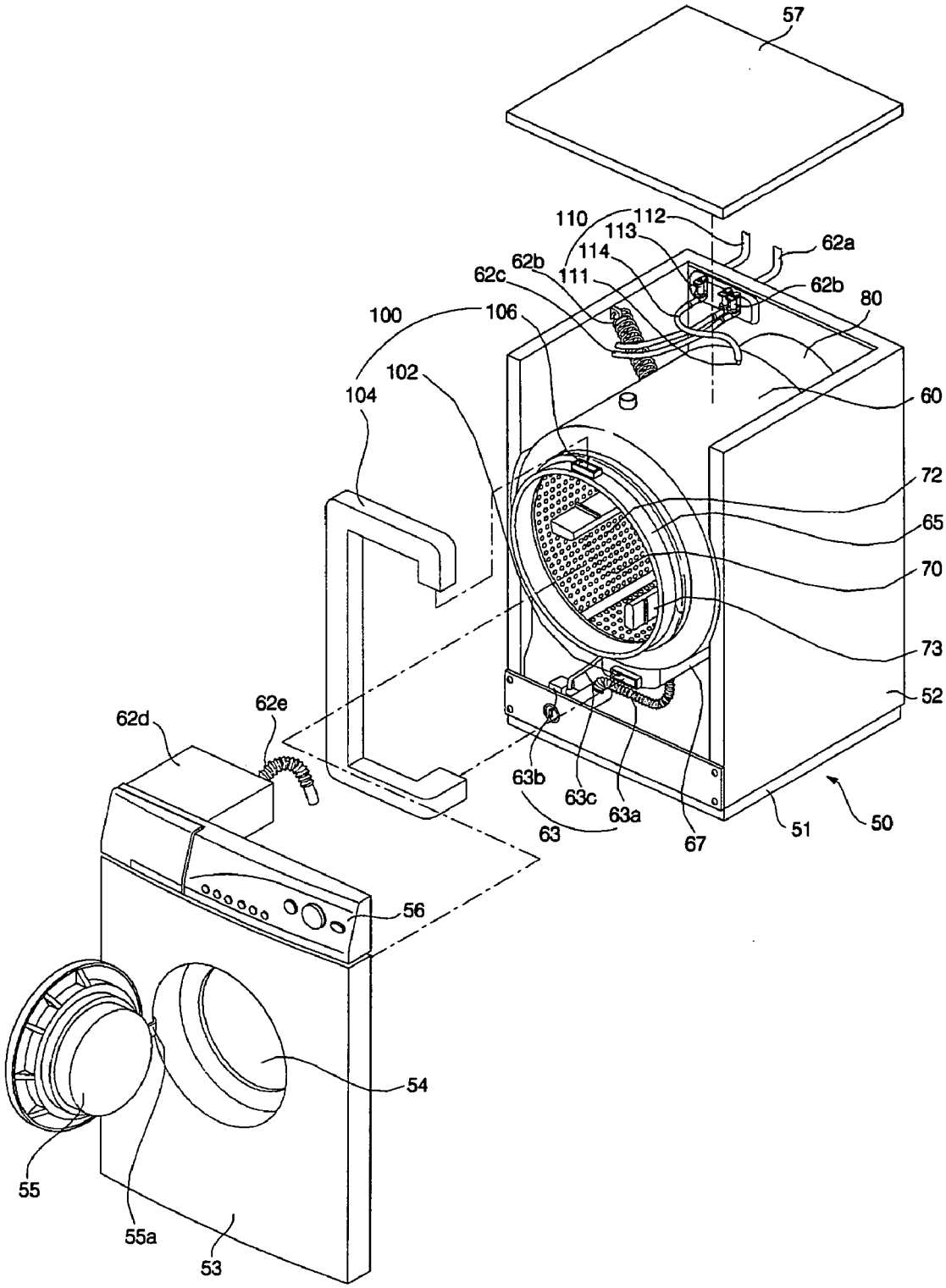
FIG. 3 is a longitudinal sectional view illustrating the washing machine with drying function according to the first preferred embodiment of the present invention during the drying operation of the washing machine with drying function.
Figure 4:
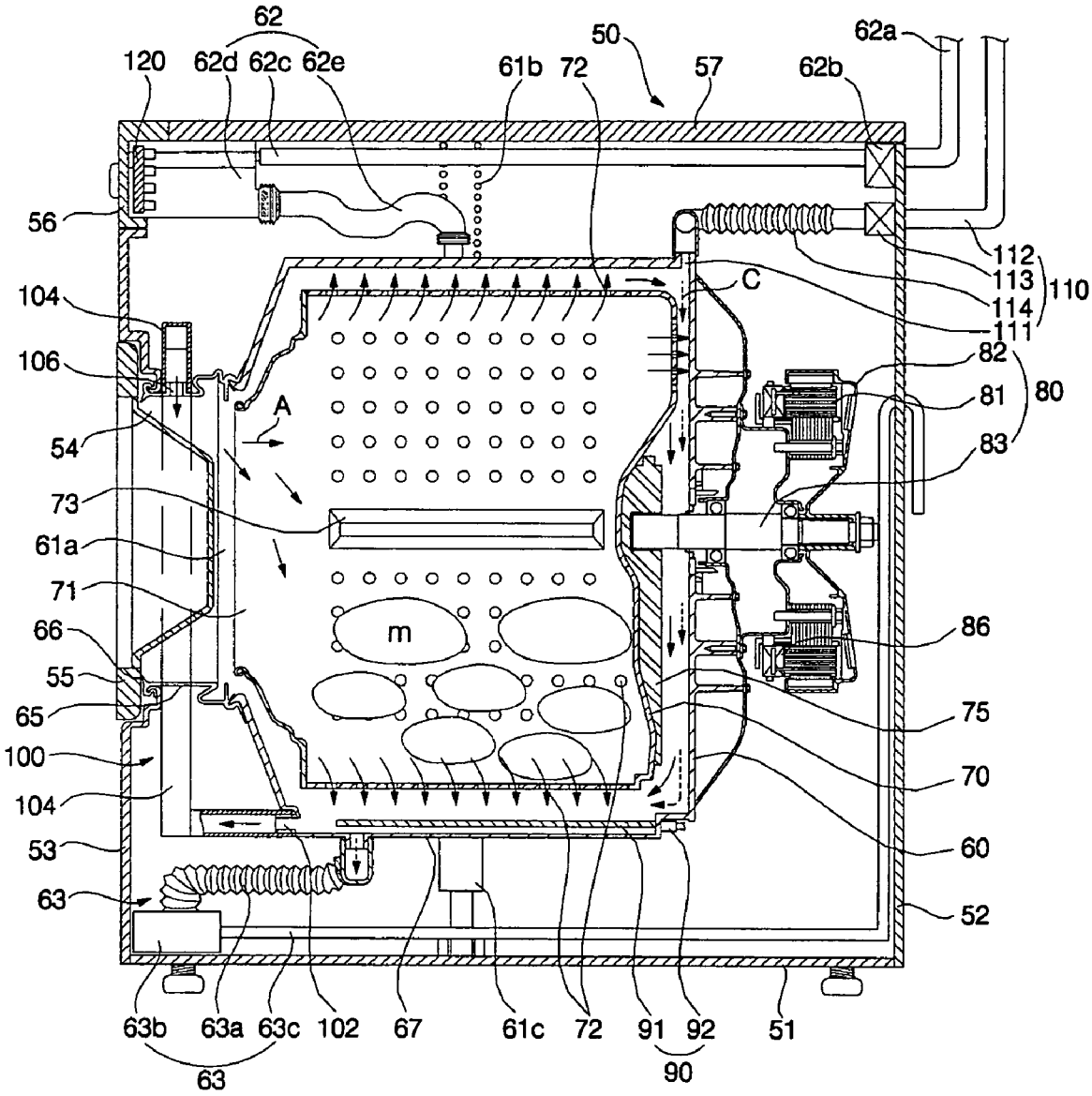
FIG. 4 is a partially exploded perspective view illustrating the washing machine with drying function according to the first preferred embodiment of the present invention.

FIG. 2 is a longitudinal sectional view illustrating a washing machine with drying function according to a first preferred embodiment of the present invention during the washing operation of the washing machine with drying function, FIG. 3 is a longitudinal sectional view illustrating the washing machine with drying function according to the first preferred embodiment of the present invention during the drying operation of the washing machine with drying function, and FIG. 4 is a partially exploded perspective view illustrating the washing machine with drying function according to the first preferred embodiment of the present invention.

As shown in FIGS. 2 to 4, the washing machine with drying function according to the first preferred embodiment of the present invention comprises: a tub 60 disposed in a cabinet 50 while being supported; a drum 70 rotatably disposed inside the tub 60 for receiving the laundry m; a driving unit 80 for rotating the drum 70; a heater 90 mounted to the tub 60 for heating wash water W or air A in the tub 60; and a circulating channel 100 for guiding the air A, heated by the heater 90, to the outside of the tub 60 and then supplying the air A into the drum 70.

The cabinet 50 comprises: a base pan 51; a cabinet body 52 fixedly disposed on the base pan 51; a cabinet cover 53 attached to the front part of the cabinet body 52; and a top plate 57 fixedly disposed on the top part of the cabinet body 52.

The cabinet cover 53 is provided with a laundry inlet/outlet hole 54 for allowing the laundry m to be put into or taken out of the drum 70 therethrough. To the cabinet cover 53 is connected a door 55 for opening and closing the laundry inlet/outlet hole 54 in such a manner that the door 55 can be hingedly moved by means of a hinge 55*a*.

At the upper part of the cabinet cover 53 or the upper surface of the top plate 57 is disposed a control panel 56 for inputting conditions of the washing machine with drying function, such as operation modes, operation time, etc.

The tub 60 is formed in the shape of a cylinder that is disposed horizontally or at a slope of predetermined degrees. The tub 60 is provided with an opening hole 61*a*, which is disposed at the rear of the laundry inlet/outlet hole 54. The tub 60 is connected to the cabinet body 52 by springs 61*b*. The tub 60 is also connected to the base pan 51 by a damper 61*c*.

To the tub 60 is connected a water-supply unit 62 for supplying wash water into the tub 60.

The water-supply unit 62 comprises: a water-supply valve 62*b* connected to an external hose 62*a* for allowing wash water W supplied from the external hose 62*a* to flow therethrough or stopping the wash water W from flowing therethrough; a water-supply hose 62*c* for guiding the wash water W having passed through the water-supply valve 62*b*; a detergent box 62*d* disposed such that the wash water W guided along the water-supply hose 62*c* passes through the detergent box 62*d*; and a water-supply bellows 62*e* for guiding the wash water W having passed through the detergent box 62*d* into the tub 60.

To the tub 60 is also connected a drainage unit 63 for draining contaminated wash water W or water separated from the laundry m out of the washing machine.

The drainage unit 63 comprises: a drainage bellows 63*a* connected to the tub 60 for guiding wash water W or water from the tub 60 to a drainage pump 63*b* therealong; the drainage pump 63*b* for pumping out the wash water W or the water guided along the drainage bellows 63*a*; and a drainage hose 63*c* for guiding the wash water W or the water pumped out by the drainage pump 63*b* out of the washing machine with drying function.

To the tub 60 is attached a gasket 65 for preventing the laundry m, wash water W, and air A from flowing out of the space between the tub 60 and the cabinet cover 53 and between the tub 60 and the door 55.

Specifically, the gasket 65 has one end connected to the opening hole 61*a* of the tub 60 and the other end connected to the laundry inlet/outlet hole 54 of the cabinet cover 53. At the end of the gasket 65, which is connected to the laundry inlet/outlet hole 54 of the cabinet cover 53, is formed a sealing part 66, which comes into tight contact with the door 55 when the door 55 is closed.

At the tub 60 is formed a heater-accommodating groove part 67 for accommodating the heater 90.

The heater-accommodating groove part 67 extends, from the front end to the rear end of the tub 60, along the middle area of the bottom part of the tub 60 while being indented such that the wash water W and the air A can be easily heated by the heater 90.

The drum 70 is formed in the shape of a cylinder that is disposed horizontally or at a slope of predetermined degrees in the tub 60. The drum 70 is provided at the front center part thereof with an opening hole 71 for allowing the laundry m or wash water to be introduced into and taken out of the drum 70 therethrough. The drum 70 is provided at the circumferential part thereof or the rear part thereof with through-holes 72 for allowing wash water W and air A to be introduced into and discharged out of the drum 70 therethrough. To the inner circumferential part of the drum 70 are attached lifts 73 for lifting the laundry m such that the laundry m is lifted by the lifts 73 and then dropped from the lifts 73.

To the drum 70 is attached a spider 75, to which the driving unit 80 is connected.

The driving unit 80 may comprise a motor mounted to the rear part of the tub 60 for directly rotating the drum 70. Alternatively, the drum-driving unit 80 may comprise: a drive shaft penetrating the rear part of the tub 60, the drive shaft having the front end connected to the drum 70 and the rear end protruded toward the rear of the tub 60; a motor mounted to the tub 60; a driving pulley attached to a rotary shaft of the motor; a driven pulley attached to the rear end of the drive shaft; and a belt wound on the driving pulley and the driven pulley. It should be noted that the drum-driving unit 80 comprises the motor for directly rotating the drum 70 in the following description.

The motor 80 comprises: a stator 81 mounted to the rear part of the tub 60; a rotor 82 rotating by means of an electromagnetic force created between the stator 81 and the rotor 82; and a drive shaft 83 penetrating the tub 60, the drive shaft 83 having the rear end connected to the rotor 82 and the front end connected to the drum 70, especially to the spider 75.

The heater 90 comprises: a heater rod 91 disposed in the heater-accommodating groove part 67 of the tub 60 while extending in the longitudinal direction of the heater-accommodating groove part 67; and a current-applying part 92 for applying electric current to the heater rod 91.

The circulating channel 100 has one end disposed near the heater 90.

The circulating channel 100 has the other end disposed inside the gasket 65 for supplying air A having been guided to the inside of the gasket 65 into the drum 70 through the opening hole 61*a* of the tub 60 and the opening hole 71 of the drum 70. Alternatively, the other end of the circulating channel 100 may be disposed inside the tub 60 such that the air having been guided to the inside of the tub 60 is supplied into the drum 70 through the opening hole 71 of the drum 70. It should be noted that the other end of the circulating channel 100 is disposed inside the gasket 65 in the following description.

The circulating channel 100 comprises: a tub-side communicating hole part 102 formed at one side of the tub 60 for allowing air A to flow out of the tub 60 therethrough; a circulating duct 104 having one end connected to the tub-side communicating hole part 102 of the tub 60 and the other end extending to the outer circumferential part of the gasket 65; and a gasket-side communicating hole part 106 formed at the gasket 65 for allowing air guided into the circulating duct 104 to flow to the inside of the gasket 65 therethrough.

Preferably, the tub-side communicating hole part 102 is disposed adjacent to the heater 90. Specifically, the tub-side communicating hole part 102 is formed at the heater-accommodating groove part 67 such that air A in the tub 60 flows into the circulating duct 104 after having passed through the heater 90 during the drying operation of the washing machine with drying function.

Most preferably, the tub-side communicating hole part 102 is formed at the front part of the tub 60, especially, at the front part of the heater-accommodating groove part 67, in consideration of the length by which the circulating duct 104 extends.

The gasket-side communicating hole part 106 is formed at the outer circumferential surface of the gasket 65 while being protruded from the outer circumferential surface of the gasket 65 such that the circulating duct 104 is inserted in or fitted on the gasket-side communicating hole part 106.

The washing machine with drying function further comprises: cooling water supplying means 110 for supplying cooling water to the inner wall of the tub 60 to condense air A inside the tub 60.

The cooling water supplying means 110 comprises: a cooling water supplying member 111 formed at the tub for guiding cooling water to the inner wall of the tub 60.

Preferably, the cooling water supplying member 111 is formed at the position where the cooling water does not flow into the drum 70 through the through-holes 72 of the drum 70.

Specifically, the cooling water supplying member 111 is formed at the position where the cooling water is guided to the inner circumferential surface of the tub 60. Alternatively, the cooling water supplying member 111 may be formed at the position where the cooling water is guided to the inner surface of the rear part of the tub 60.

The cooling water supplying means 110 further comprises: a cooling water supplying unit for supplying cooling water to the cooling water supplying member 111.

The cooling water supplying unit comprises: a cooling water valve 113 connected to an external hose 112 for allowing cooling water supplied from the external hose 112 to flow therethrough or stopping the cooling water from flowing therethrough; and a cooling water supplying hose 114, having one end communicating with the cooling water valve 113 and the other end communicating with the cooling water supplying member 111, for guiding cooling water having passed through the cooling water valve 113 to the inner wall of the tub 60.

The washing machine with drying function further comprises: a control unit 120 for controlling the water-supply valve 62*b*, the drainage pump 63*b*, the motor 80, the heater 90, and the cooling water valve 113 according to users' operational instructions inputted by means of the control panel 56. Specifically, the control unit 120 turns the heater 90 on/off, and drives the motor 80 at high speed, so as to dry the laundry m during the drying operation of the washing machine with drying function.

Reference numeral 86 indicates a Hall sensor mounted to the stator 81 for sensing revolutions per minute (RPM) of the motor 80.

The operation of the washing machine with drying function according to the present invention will now be described.

First, when a user puts the laundry m into the drum 70, closes the door 55, inputs various operation modes, such as a washing mode, a rinsing mode, a dewatering mode, and a drying mode by means of the control panel 56, and then operates-the washing machine with drying function, the control unit 120 controls the water-supply valve 62*b*, the drainage pump 63*b*, the motor 80, the heater 90, and the cooling water valve 113 according to the users' operational instructions inputted by means of the control panel 56 as follows.

When the washing mode is selected, the control unit 120 turns on the water-supply valve 62*b* to supply wash water (water containing a detergent dissolved therein) W to the tub 60. The wash water W supplied to the tub 60 is introduced into the drum 70 through the opening hole 71 or the through-holes 72 of the drum 70. As a result, the laundry m is wetted by the wash water W introduced in the drum 70.

When the wash water is supplied up to a predetermined level, the control unit 120 turns off the water-supply valve 62*b*, and drives the motor 80.

As the motor 80 is driven, the drum 70 is rotated. As a result, laundry m in the drum is shaken by the lifts 73, and therefore, contaminants are removed from the laundry m.

When the boiling mode is selected, the control unit 120 turns on the heater 90 while the motor 80 is driven. As a result, the wash water around the heater 90 is heated by the heater 90, and therefore, the laundry m is sterilized at high temperature.

After the above-described washing operation of the washing machine with drying function has been performed for a prescribed period of time, the control unit 120 stops the motor 80, and drives the drainage pump 63*b*.

As the drainage pump 63*b* is driven, the contaminated wash water W in the tub 60 is drained out of the washing machine with drying function through the drainage unit 63.

After the contaminated wash water W in the tub 60 has been completely drained out of the washing machine with drying function, the control unit 120 stops the drainage pump 63*b*.

When the rinsing mode is selected, the control unit 120 controls the water-supply valve 62*b*, the motor 90, and the drainage pump 63*b* as in the washing operation of the washing machine with drying function, to rinse out bubbles left in the laundry m.

Specifically, new wash water (clean water) W is supplied into the tub 60 through the water-supply unit 62. The new wash water W supplied into the tub 60 is introduced into the drum 70 such that laundry m in the drum 70 is wetted by the new wash water. As a result, bubbles left in the laundry m are rinsed out by the new wash water W while the drum 70 is rotated. The contaminated wash water W, which has been used to rinse the laundry m in the drum 70, is drained out of the washing machine with drying function through the drainage unit 63.

When the dewatering mode is selected, the control unit 120 drives the motor 80 at high speed. As the motor 80 is driven at high speed, the drum is rotated at high speed. As a result, the water is centrifugally separated from the laundry m while the laundry m is pushed against the inner circumferential part of the drum 70. The water centrifugally separated from the laundry m is drained out of the washing machine with drying function through the drainage unit 63.

When the drying mode is selected, the control unit 120 controls the motor 80, the heater 90, and the cooling water valve 113, to perform the drying operation of the washing machine with drying function.

Figure 5:
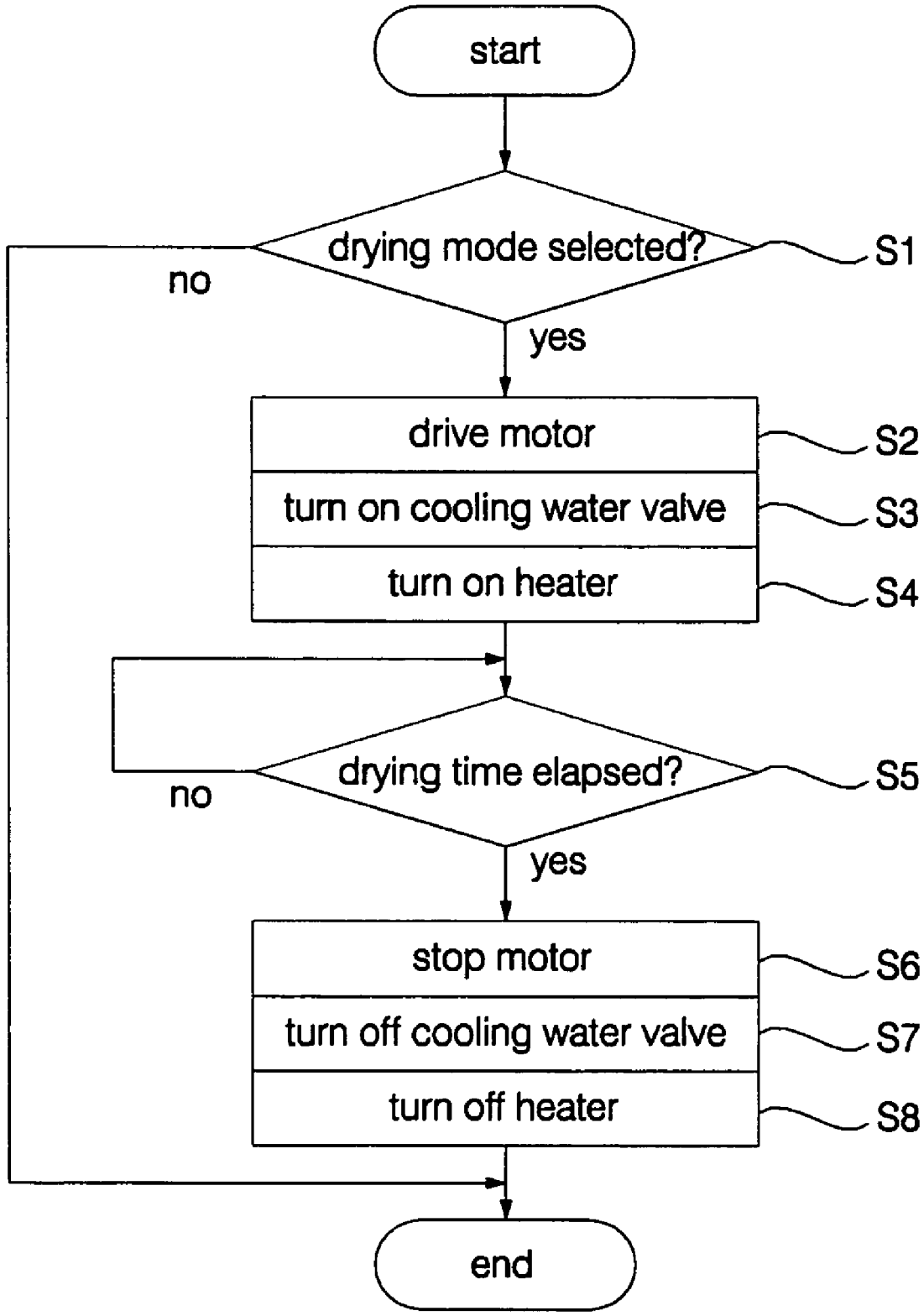
FIG. 5 is a flow chart illustrating a method of controlling a washing machine with drying function according to a first preferred embodiment of the present invention.

FIG. 5 is a flow chart illustrating a method of controlling a washing machine with drying function according to a first preferred embodiment of the present invention.

When the drying mode is selected, the control unit 120 drives the motor 80 at high speed, for example, at a speed of more than 400 RPM, such that air A inside the drum 70 flows to the heater 90, passes through the circulating channel 100, and is then supplied into the drum 70, turns on the cooling water valve 113 to supply cooling water C to the inner wall of the tub 60 such that the air A in the tub 60 is condensed at the inner wall of the tub 60, and turns on the heater 90 such that the air A in the tub 60 is heated by the heater 90, as shown in FIGS. 3 and 4, to dry the laundry m (S1, S2, S3, and S4).

The laundry drying operation will be described hereinafter in more detail.

The air A inside the drum 70 passes through the through-holes 72 of the drum 70 as the drum 70 is rotated at high speed, and then flows along the space between the outer wall of the drum 70 and the inner wall of the tub 60. At this time, the air A is condensed by the cooling water C. As a result, the humidity of the air A is decreased. The low-humidity air A flows toward the tub-side communicating hole part 102.

The low-humidity air A flowing toward the tub-side communicating hole part 102 is heated by the heater 90. As a result, the temperature of the air is increased. The high-temperature and low-humidity air passes through the tub-side communicating hole part 102, the circulating duct 104, and the gasket-side communicating hole part 106 in order, and then moves to the inside of the gasket 65.

The high-temperature and low-humidity air having moved to the inside of the gasket 65 passes through the opening hole 61*a* of the tub 60 and the opening hole 71 of the drum in order, and is then introduced into the drum 70, where heat exchange occurs between the laundry m and the high-temperature and low-humidity air such that the laundry m is dried. As a result, the humidity of the air is increased. In this way, the air is circulated/condensed/heated to continuously dry the laundry m.

The cooling water C supplied to the inner wall of the tub 60 flows toward the bottom part of the tub 60, and is then drained out of the washing machine with drying function through the drainage unit 63.

After the drying operation has been performed for a prescribed period of time, i.e., the laundry drying time has elapsed, the control unit 120 stops the motor 80, turns the heater 90 off, and turns the cooling water valve 113 off (S5, S6, S7, and S8).

When the amount of the air passing through the heater 90 is small in the washing machine with drying function, the heater 90 may be overheated, and therefore, damaged. For this reason, the heater 90 may be turned on when the motor 80 is rotated at a speed of more than a predetermined level, and turned off when the motor 80 is rotated at a speed of less than the predetermined level.

Figure 6:
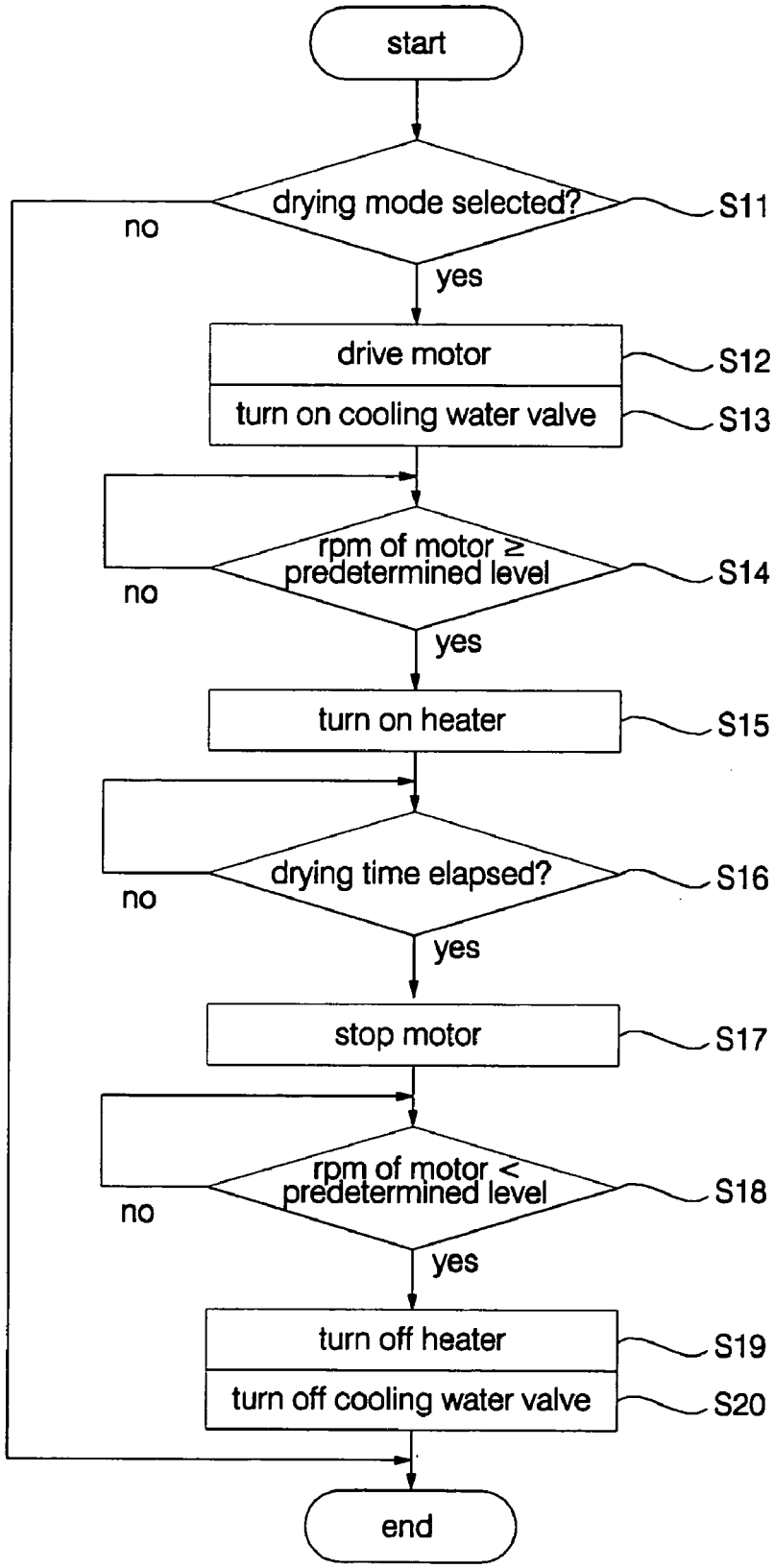
FIG. 6 is a flow chart illustrating a method of controlling a washing machine with drying function according to a second preferred embodiment of the present invention.

FIG. 6 is a flow chart illustrating a method of controlling a washing machine with drying function according to a second preferred embodiment of the present invention.

When the drying mode is selected, the control unit 120 drives the motor 80, and turns the cooling water valve 113 on (S11, S12, and S13).

As the RPM of the motor 80 is gradually increased, the drum 70 is rotated. As a result, the air A in the drum 70 passes through the through-holes 72, and then flows along the space between the outer wall of the drum 70 and the inner wall of the tub 60. At this time, the air A is condensed by the cooling water C flowing along the inner wall of the tub 60, and then flows toward the heater 90. Subsequently, the air passes through the heater 90 without heat exchange between the air and the heater 90, and is then introduced into the drum 70 through the circulating channel 100.

When the RPM of the motor reaches a predetermined level as the motor 80 is accelerated, the control unit 120 turns the heater 90 on (S14 and S15).

As the motor 80 is driven at a speed of the predetermined level or more, the drum is rotated at high speed. As a result, the amount of air circulating along the drum 60, the tub 70, the heater 90, the circulating channel 100, and the drum 60 is increased. Consequently, the heater 90 heats the circulating air A without being overheated or damaged.

Specifically, the air A in the drum 70 is changed into low-humidity air while passing through the tub 70, and is then changed into high-temperature and low-humidity air while passing through the heater 90. The high-temperature and low-humidity air is introduced into the drum 70 through the circulating channel 100 such that the laundry m in the drum 70 is dried by the high-temperature and low-humidity air.

After the drying operation has been performed for a prescribed period of time, i.e., the laundry drying time has elapsed, the control unit 120 stops the motor 80 (S16 and S17).

When the motor 80 is stopped, the drum 70 is still rotated although the speed of the drum 70 is gradually decreased. Consequently, the laundry m is continuously agitated in the drum 70. At this time, the air A circulating along the drum 70, the tub 60, the heater 90, and the circulating channel 100 is condensed by the cooling water C, and heated by the heater 90. Consequently, the laundry m is continuously dried in the drum 70.

When the RPM of the motor 80 is less than the predetermined level, the control unit 120 turns the heater 90 and the cooling water valve off (S18, S19, and S20).

Figure 7:
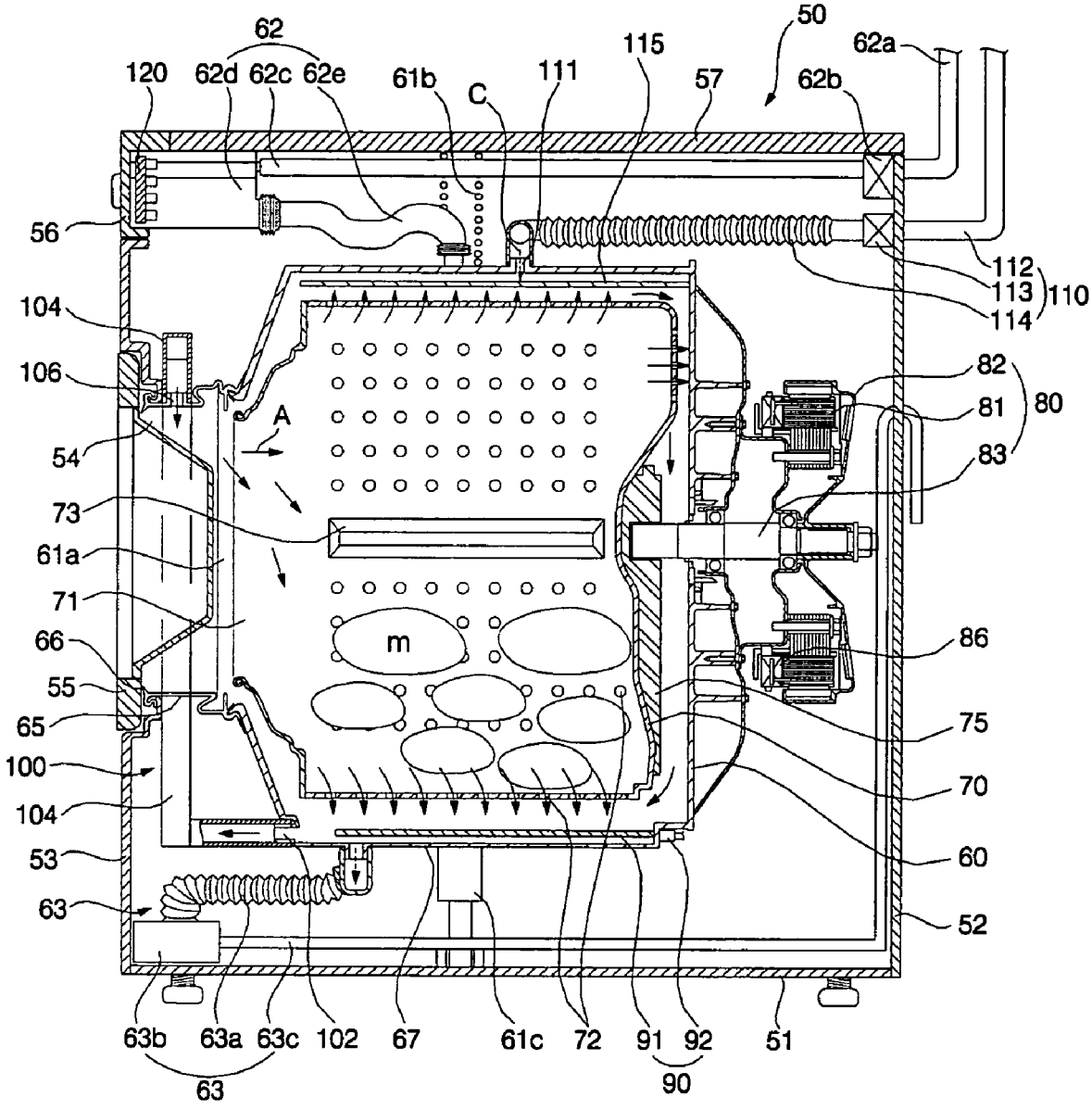
FIG. 7 is a longitudinal sectional view illustrating a washing machine with drying function according to a second preferred embodiment of the present invention during the drying operation of the washing machine with drying function.
Figure 8:
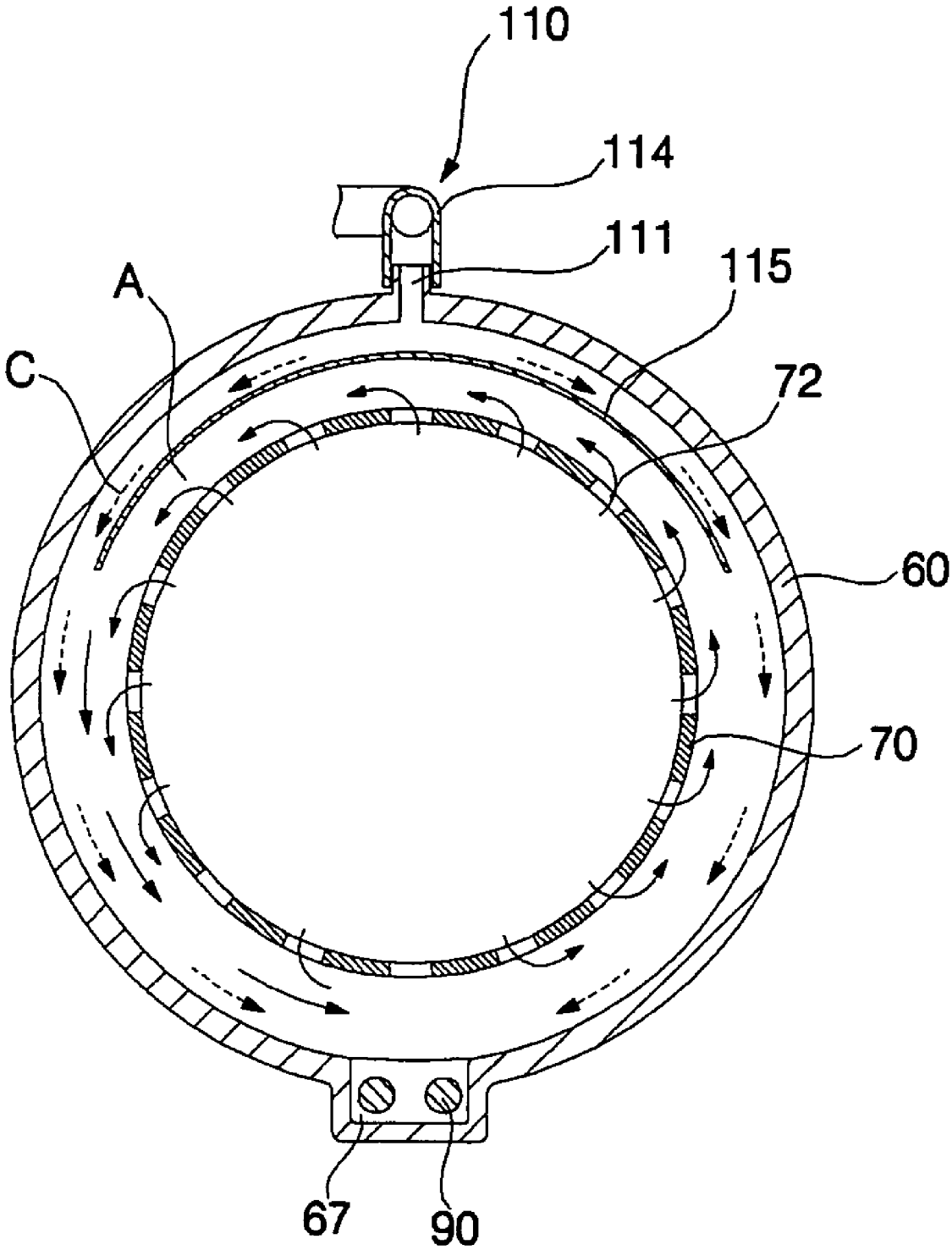
FIG. 8 is a cross-sectional view illustrating principal components of the washing machine with drying function according to the second preferred embodiment of the present invention during the drying operation of the washing machine with drying function.

FIG. 7 is a longitudinal sectional view illustrating a washing machine with drying function according to a second preferred embodiment of the present invention during the drying operation of the washing machine with drying function, and FIG. 8 is a cross-sectional view illustrating principal components of the washing machine with drying function according to the second preferred embodiment of the present invention during the drying operation of the washing machine with drying function.

In the washing machine with drying function according to the second embodiment of the present invention shown in FIGS. 7 and 8, the cooling water supplying member 111, which guides cooling water to the inner wall of the tub 60, is formed at the position where the cooling water is guided to the inner surface of the rear part of the tub 60 or at the position where the cooling water is guided to the inner circumferential surface of the tub 60. Between the outer circumferential surface of the drum 70 and the inner circumferential surface of the tub 60 is disposed a heat spreader 115 for preventing cooling water supplied to the tub 60 from being introduced into the drum 70 through the through-holes 72 of the drum 70 and facilitating condensation of hot wind.

The heat spreader 115 is made of a metal material having high thermal conductivity, such as silver (Ag), copper (Cu), or aluminum (Al).

In the washing machine with drying function according to the second embodiment of the present invention, air coming into contact with the heat spreader 115 is condensed through contact between the air and the heat spreader 115, and air not coming into contact with the heat spreader 115 is condensed through contact between the air and the cooling water flowing along the inner wall of the tub 60.

The washing machine with drying function according to the second preferred embodiment of the present invention is identical in construction and operation to the washing machine with drying function according to the first preferred embodiment of the present invention except for the cooling water supplying member 111 and the heat spreader 115. Therefore, other components of the washing machine with drying function according to the second preferred embodiment of the present invention, which correspond to those of the washing machine with drying function according to the first preferred embodiment of the present invention, are indicated by the same reference numerals as those of the washing machine with drying function according to the first preferred embodiment of the present invention, and a detailed description thereof will not be given.

Figure 9:
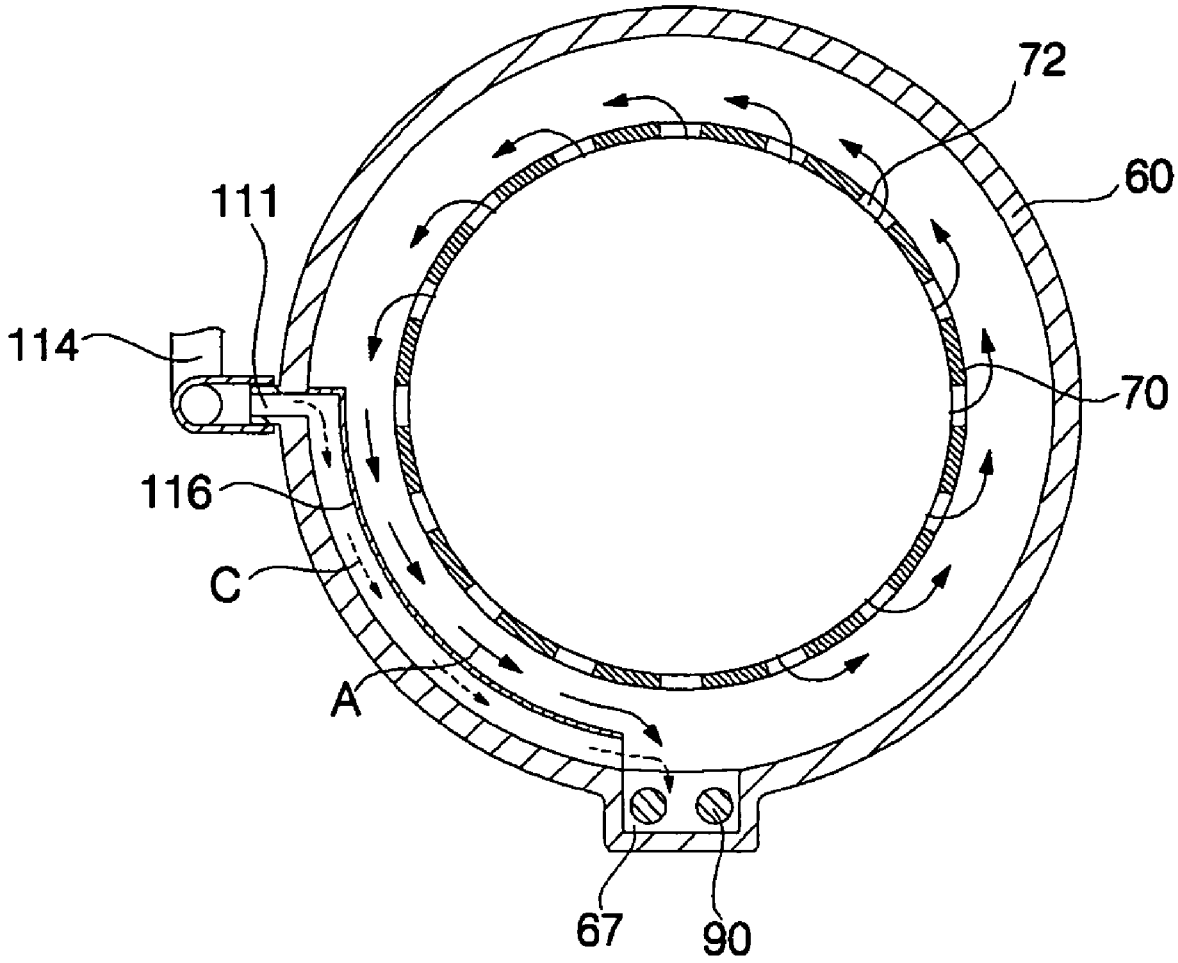
FIG. 9 is a cross-sectional view illustrating principal components of a washing machine with drying function according to a third preferred embodiment of the present invention during the drying operation of the washing machine with drying function.

FIG. 9 is a cross-sectional view illustrating principal components of a washing machine with drying function according to a third preferred embodiment of the present invention during the drying operation of the washing machine with drying function.

In the washing machine with drying function according to the third embodiment of the present invention shown in FIG. 9, the cooling water supplying member 111, which guides cooling water to the inner wall of the tub 60, is formed at the position where the cooling water is guided to the inner circumferential surface of the tub 60 or at the position where the cooling water is guided to the inner rear part of the tub 60. At the inner circumferential surface of the tub 60 or at the inner surface of the rear part of the tub 60 is disposed a cooling water flow pipe 116, having one end connected to the cooling water supplying member 111 and the other end connected to the inner bottom part of the tub 60 while communicating with the inner bottom part of the tub 60, for allowing the cooling water to flow along the inner circumferential surface of the tub 60 therethrough for a long time.

The washing machine with drying function according to the third preferred embodiment of the present invention is identical in construction and operation to the washing machine with drying function according to the first preferred embodiment of the present invention except for the cooling water supplying member 111 and the cooling water flow pipe 116. Therefore, other components of the washing machine with drying function according to the second preferred embodiment of the present invention, which correspond to those of the washing machine with drying function according to the first preferred embodiment of the present invention, are indicated by the same reference numerals as those of the washing machine with drying function according to the first preferred embodiment of the present invention, and a detailed description thereof will not be given.

In the washing machine with drying function according to the third preferred embodiment of the present invention, the cooling water flows along the inner circumferential surface of the tub 60 for a long time, whereby condensing efficiency of the washing machine with drying function is improved.

Figure 10:
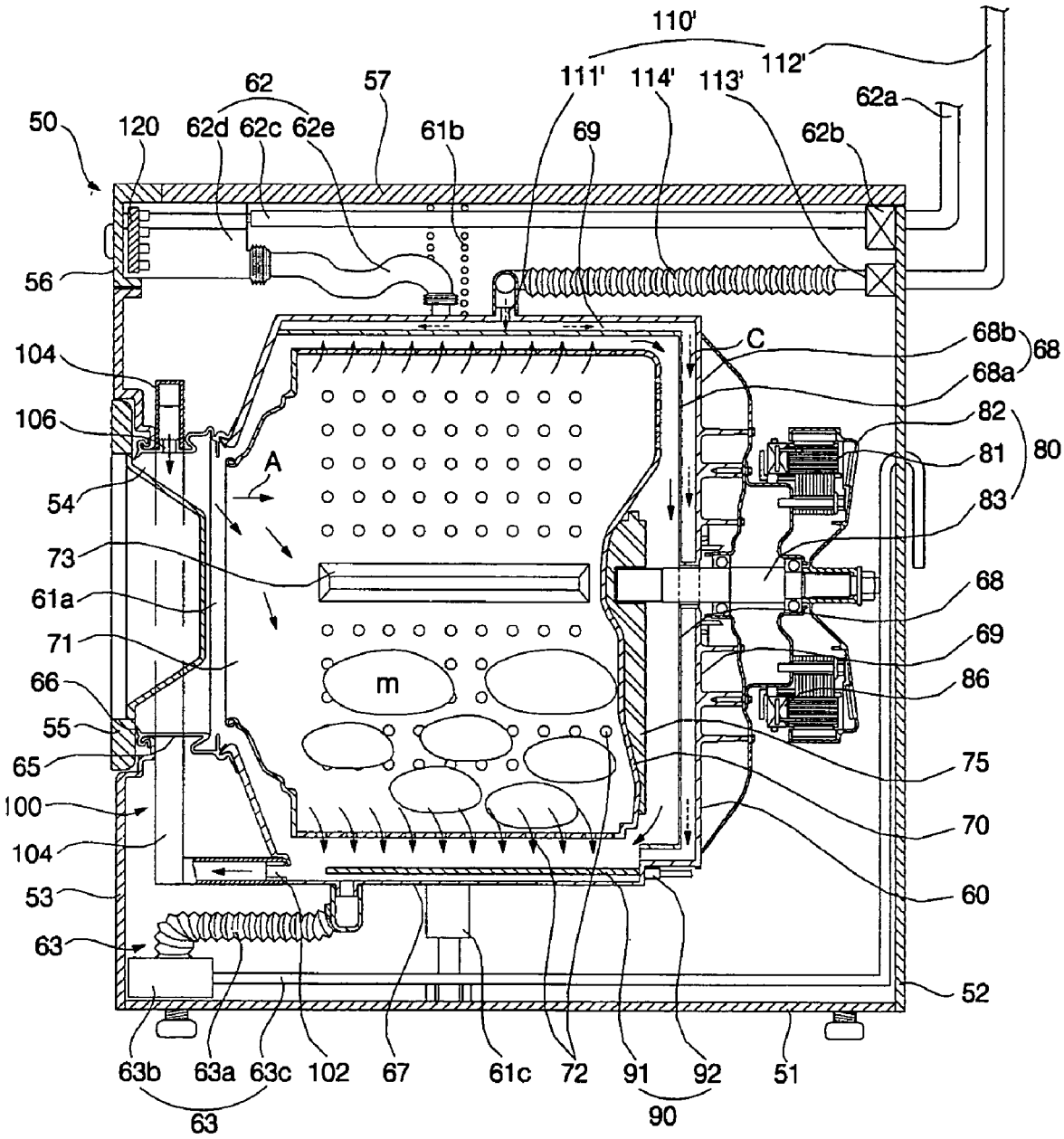
FIG. 10 is a longitudinal sectional view illustrating a washing machine with drying function according to a fourth preferred embodiment of the present invention during the drying operation of the washing machine with drying function.
Figure 11:
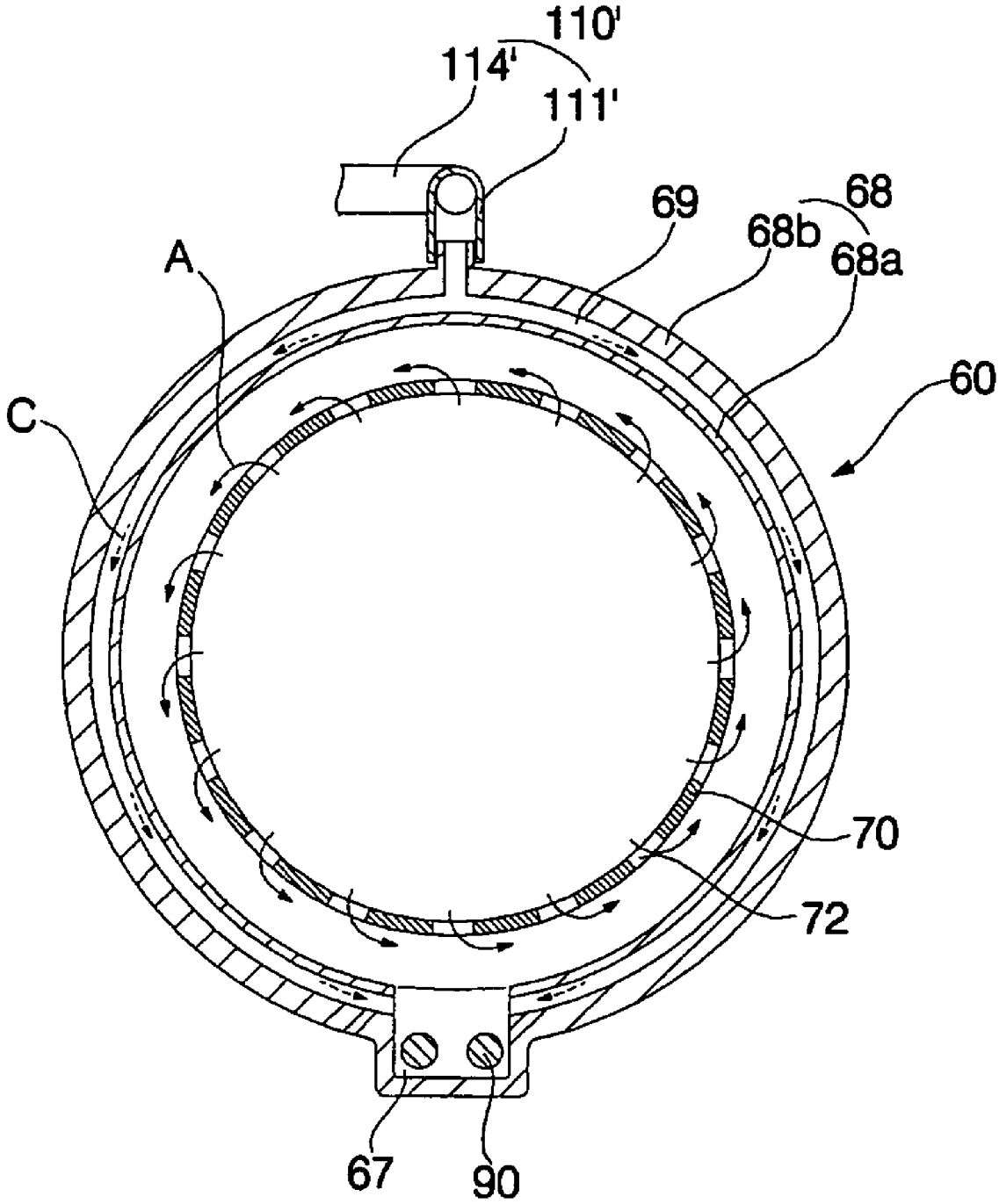
FIG. 11 is a cross-sectional view illustrating principal components of the washing machine with drying function according to the fourth preferred embodiment of the present invention during the drying operation of the washing machine with drying function.

FIG. 10 is a longitudinal sectional view illustrating a washing machine with drying function according to a fourth preferred embodiment of the present invention during the drying operation of the washing machine with drying function, and FIG. 11 is a cross-sectional view illustrating principal components of the washing machine with drying function according to the fourth preferred embodiment of the present invention during the drying operation of the washing machine with drying function.

In the washing machine with drying function according to the fourth preferred embodiment of the present invention, as shown in FIGS. 10 and 11, the tub 60 comprises: a double wall part 68 having a cooling channel 69 defined between an inner wall 68*a* and an outer wall 68*b* of the tub 60.

The double wall part 68 may be formed at the entire tub 60, or may be formed at any one of the circumferential part and the rear part of the tub 60. It should be noted that the inner wall 68*a* and the outer wall 68*b* are formed not only at the circumferential part of the tub 60 but also at the rear part of the tub 60 in the following description.

The cooling channel 69 communicates with the inner lower part of the tub 60 such that the cooling water flows to the inner lower part of the tub 60.

The washing machine with drying function further comprises: cooling fluid supplying means 110' for supplying cooling water C to the cooling channel 69.

The cooling fluid supplying means 110' may supply external cool air to the cooling channel 69 such that damp air inside the tub 60 can be condensed in an air-cooling fashion, or may supply cooling water C to the cooling channel 69 such that air inside the tub 60 can be condensed in a water-cooling fashion. It should be noted that the air inside the tub 60 is condensed in the water-cooling fashion in the following description.

The cooling fluid supplying means 110' comprises: a cooling water supplying member 111' formed at the tub 60 for guiding cooling water to the cooling channel 69.

Preferably, the cooling water supplying member 111' is formed on the outer wall 68*b* of the tub 60.

The cooling fluid supplying means 110' further comprises: a cooling water supplying unit for supplying cooling water to the cooling water supplying member 111'.

The cooling water supplying unit comprises: a cooling water valve 113' connected to an external hose 112' for allowing cooling water supplied from the external hose 112' to flow therethrough or stopping the cooling water from flowing therethrough; and a cooling water supplying hose 114', having one end communicating with the cooling water valve 113' and the other end communicating with the cooling water supplying member 111', for guiding cooling water having passed through the cooling water valve 113' to the inner wall of the tub 60.

The washing machine with drying function according to the fourth preferred embodiment of the present invention is identical in construction and operation to the washing machine with drying function according to the first preferred embodiment of the present invention except for the cooling channel 69, the double wall part 68, and the cooling fluid supplying means 110'. Therefore, other components of the washing machine with drying function according to the fourth preferred embodiment of the present invention, which correspond to those of the washing machine with drying function according to the first preferred embodiment of the present invention, are indicated by the same reference numerals as those of the washing machine with drying function according to the first preferred embodiment of the present invention, and a detailed description thereof will not be given.

In the washing machine with drying function according to the fourth preferred embodiment of the present invention, when the cooling water valve 113' is turned on, cooling water supplied through the external hose 112' passes through the cooling water valve 113', the cooling water supplying hose 114', and the cooling water supplying member 111' in order, and is then supplied to the cooling channel 69 of the double wall part 68. The cooling water, having passed through the cooling channel 69, is drained out of the washing machine with drying function.

When the drum 70 is rotated at high speed, the air A passing through the space between the drum 70 and the tub 60 is condensed while heat of the air A is transferred to the cooling water C through the inner wall 68*a* of the tub 60. The subsequent operation of the washing machine with drying function is the same as the first preferred embodiment of the present invention, and therefore, a detailed description thereof will not be given.

As apparent from the above description, the washing machine with drying function according to the present invention has the following effects.

The washing machine with drying function of the present invention has an effect in that the heater is mounted in the tub for heating wash water or air in the tub, and the circulating channel is connected to the tub for guiding the air, heated by the heater, to the outside of the tub and then supplying the air into the drum such that the laundry in the drum is dried, whereby a drying heater, a circulating fan, and a fan motor are not required, and therefore, the structure of the washing machine with drying function is simplified, the manufacturing costs of the washing machine with drying function are reduced, and noise generated from the washing machine with drying function is minimized.

The washing machine with drying function of the present invention has an effect in that capacities of the tub and the drum are increased as much as the space occupied by the drying heater and the condensing duct, whereby washing and drying capacities of the washing machine with drying function are increased.

The washing machine with drying function of the present invention has an effect in that the washing machine with drying function further comprises the cooling water supplying means for supplying cooling water to the inner wall of the tub such that high-humidity air inside the tub is condensed by the cooling water flowing along the inner wall of the tub, whereby an additional condensing duct is not required, and therefore, the structure of the washing machine with drying function is simplified, and the manufacturing costs of the washing machine with drying function are reduced.

The washing machine with drying function of the present invention has an effect in that the tub comprises the double wall part having the cooling channel defined between the inner wall of the tub and the outer wall of the tub, and the washing machine with drying function further comprises the cooling fluid supplying means for supplying cooling water to the cooling channel such that high-humidity air inside the tub is condensed through heat exchange between the air and the inner wall of the tub, whereby an additional condensing duct is not required, and therefore, the structure of the washing machine with drying function is simplified, the manufacturing costs of the washing machine with drying function are reduced, and condensing efficiency of the washing machine with drying function is improved as the heat exchange area of the high-humidity air is increased.

Also, the method of controlling the washing machine with drying function according to the present invention has an effect in that the heater is turned on when the motor is rotated at a speed of more than a predetermined level, and turned off when the motor is rotated at a speed of less than the predetermined level, whereby the heater is prevented from being overheated and damaged.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine with a drying function, comprising:

a tub disposed and supported in a cabinet;

a drum rotatably disposed inside the tub for receiving laundry, the drum being provided with through-holes;

a driving unit for rotating the drum;

a heater mounted to the tub for heating wash water or air in the tub; and a circulating channel for guiding air heated by the heater to the outside of the tub and then supplying the air into the drum, wherein the tub is provided with a heater-accommodating groove part for accommodating the heater, and the circulating channel has one end communicating with the heater-accommodating groove part, wherein the circulating channel is disposed between a front portion of the tub and a front cover of the cabinet, and wherein the circulating channel comprises:

a tub-side communicating hole formed at a lower front portion of the tub for allowing air heated by the heater to flow out of the tub therethrough;

a circulating duct having one end connected to the tub-side communicating hole, a conduit extending upwardly, and the other end connected to an upper portion of a gasket; and a gasket-side communicating hole port formed at the gasket for allowing air guided into the circulation duct to flow to the inside of the gasket therethrough.

2. The washing machine as set forth in claim 1, wherein the circulating channel extends near the heater.

3. The washing machine as set forth in claim 1, wherein the circulating channel extends near the heater.

4. The washing machine as set forth in claim 1, further comprising:

a door for opening and closing a laundry inlet/outlet hole formed at the cabinet; and the gasket attached to the tub for sealing the space between the door and the tub when the door is closed.

5. The washing machine as set forth in claim 1, further comprising:

a cooling water supplying means for supplying cooling water to an inner wall of the tub to condense air inside the tub.

6. The washing machine as set forth in claim 5, wherein the cooling water supplying means comprises:

a cooling water supplying member formed at the tub for guiding the cooling water to the inner wall of the tub; and a cooling water supplying unit for supplying the cooling water to the cooling water supplying member.

7. The washing machine as set forth in claim 6, wherein the cooling water supplying member is formed at the position where the supplied cooling water does not flow into the drum through the through-holes of the drum.

8. The washing machine as set forth in claim 6, wherein the cooling water supplying member is formed such that the cooling water is guided to the inner surface of the rear part of the tub.

9. The washing machine as set forth in claim 6, wherein the cooling water supplying unit comprises:

a cooling water valve connected to an external hose for allowing cooling water supplied from the external hose to flow therethrough or stopping the cooling water from flowing therethrough; and a cooling water supplying hose, having one end communicating with the cooling water valve and the other end communicating with the cooling water supplying member, for guiding cooling water having passed through the cooling water valve to the inner wall of the tub.

10. The washing machine as set forth in claim 1, wherein the tub comprises: a double wall part having a cooling channel defined between an inner wall and an outer wall of the tub, and the washing machine further comprises: a cooling fluid supplying means for supplying cooling water to the cooling channel.

11. The washing machine as set forth in claim 10, wherein the cooling channel communicates with the inner lower part of the tub such that the cooling water flows to the inner lower part of the tub.

12. The washing machine as set forth in claim 10, wherein the cooling fluid supplying means comprises:

a cooling water supplying member formed at the tub for guiding the cooling water to the cooling channel; and a cooling water supplying unit for supplying the cooling water to the cooling water supplying member.

13. The washing machine as set forth in claim 12, wherein the cooling water supplying member is formed on the outer wall of the tub.

14. The washing machine as set forth in claim 12, wherein the cooling water supplying unit comprises:

a cooling water valve connected to an external hose for allowing cooling water supplied from the external hose to flow therethrough or stopping the cooling water from flowing therethrough; and a cooling water supplying hose, having one end communicating with the cooling water valve and the other end communicating with the cooling water supplying member, for guiding cooling water having passed through the cooling water valve to the cooling water supplying member.

15. A washing machine with drying function, comprising:

a cabinet having a laundry inlet/outlet hole formed thereat;

a door for opening and closing the laundry inlet/outlet hole;

a tub disposed in the cabinet while being supported;

a drum rotatably disposed inside the tub for receiving laundry, the drum being provided with through-holes;

a driving unit for rotating the drum;

a heater disposed at an inner lower part of the tub for heating wash water in the tub;

a gasket attached to the tub for sealing the space between the door and the tub when the door is closed;

a circulating channel disposed between the tub and the gasket for guiding air, having moved in the drum during rotation of the drum and heated by the heater to the outside of the tub and then supplying the air into the drum; and a cooling water supplying means for supplying cooling water to an inner wall of the tub to condense air inside of the tub, wherein the cooling water supplying means supplies cooling water to a generally upper center portion of the tub, and a heat spreader is disposed between the tub and the drum for preventing cooling water supplied to the tub from being introduced into the drum through through-holes of the drum.

16. The washing machine as set forth in claim 15, wherein the circulating channel comprises:

a tub-side communicating hole part formed near the heater for allowing air, having moved to the inner lower part of the tub and heated by the heater, to flow out of the tub therethrough;

a circulating duct having one end connected to the tub-side communicating hole part and the other end extending to the outer circumferential part of the gasket; and a gasket-side communicating hole part formed at the gasket for allowing air guided into the circulating duct to flow to the inside of the gasket therethrough.

17. The washing machine as set forth in claim 15, further comprising:

a cooling water supplying means for supplying cooling water to an inner wall of the tub to condense air inside the tub.

18. The washing machine as set forth in claim 15, wherein the tub comprises: a double wall part having a cooling channel defined between an inner wall and an outer wall of the tub, and the washing machine further comprises: a cooling fluid supplying means for supplying cooling water to the cooling channel.

19. A washing machine with a drying function, comprising:

a tub disposed and supported in a cabinet;

a drum rotatably disposed inside the tub for receiving laundry, the drum being provided with through-holes;

a driving unit for rotating the drum;

a heater mounted to the tub for heating wash water or air in the tub; and a circulating channel for guiding air heated by the heater to the outside of the tub and then supplying the air into the drum, wherein the tub is provided with a heater-accommodating groove part for accommodating the heater, the circulating channel has one end communicating with the heater-accommodating groove part, and the heater-accommodating groove part extends between the front end and the rear end of the tub along a middle area of the bottom part of the tub and has an indentation formed at the inner bottom part of the middle area of the tub.

20. A washing machine with drying function, comprising:

a tub disposed in a cabinet;

a drum rotatably disposed inside the tub for receiving laundry, the drum being provided with through-holes;

a driving unit for rotating the drum;

a heater mounted to the tub for heating wash water or air in the tub; and a circulating channel for guiding air heated by the heater to the outside of the tub and then supplying the air into the drum, wherein the tub comprises: a double wall part having a cooling channel defined between an inner wall and an outer wall of the tub, and the washing machine further comprises: a cooling fluid supplying means for supplying cooling water to the cooling channel.

21. A washing machine with drying function, comprising:

a cabinet having an upright front side with a laundry inlet/outlet hole formed thereat;

a door for opening and closing the laundry inlet/outlet hole;

a tub disposed and supported in the cabinet with a laundry inlet/outlet hole aligned with the cabinet laundry inlet/outlet hole;

a drum rotatably disposed inside the tub and having a laundry inlet/outlet opening for receiving laundry via the inlet/outlet holes in the cabinet and in the tub, the drum being provided with through-holes;

a driving unit for rotating the drum;

a heater disposed in an inner lower center groove part of the tub for heating wash water in the tub and for heating air provided to the heater via the drum through-holes;

a gasket attached to the tub for sealing the space between the door and the tub when the door is closed; and a circulating channel disposed between the tub center groove part and the gasket for guiding air heated by the heater to the outside of the tub and then supplying the air via an outlet located at the center groove part of the tub through the gasket into the drum via the laundry inlet/outlet opening of the drum.

* * * * *